United States Patent [19]

Terayama et al.

[11] 4,031,980

[45] June 28, 1977

[54] BRAKING DEVICE FOR LADDER LIFTER

[75] Inventors: Fusaji Terayama, Osaka; Tetsuo Kozai, Higashiosaku, both of Japan

[73] Assignee: Morita Pump Kabushiki Kaisha, Osaka, Japan

[22] Filed: Aug. 14, 1975

[21] Appl. No.: 604,761

[52] U.S. Cl. ..... 182/103

[51] Int. Cl.[2] ..... E06C 7/12

[58] Field of Search ..... 182/103, 102; 187/87, 187/86, 85, 82, 83

[56] References Cited

UNITED STATES PATENTS

| | | | |
|---|---|---|---|
| 844,947 | 2/1907 | Lowry | 187/86 |
| 855,646 | 6/1907 | Lehn | 187/82 |
| 1,218,285 | 3/1917 | Lewandowski | 187/82 |
| 2,583,907 | 1/1952 | Vaydo | 187/86 |
| 3,693,755 | 9/1972 | Terayama | 182/102 |
| 3,887,038 | 6/1975 | Buschbom | 187/87 |

FOREIGN PATENTS OR APPLICATIONS

| | | | |
|---|---|---|---|
| 403,201 | 4/1966 | Australia | 187/83 |
| 362,028 | 12/1931 | United Kingdom | 182/103 |

*Primary Examiner*—Reinaldo P. Machado
*Attorney, Agent, or Firm*—Hall & Houghton

[57] ABSTRACT

There is provided a cam type braking device for a ladder lifter arranged so that as soon as the lifting wire rope for the ladder lifter is broken, a brake cam is pressed against the associated ladder rail, whereby the lifter is braked and it is securely stopped at the position on the rail which it assumed at the time of breakage of the wire rope, without causing any large fall of the lifter.

3 Claims, 3 Drawing Figures

BRAKING DEVICE FOR LADDER LIFTER

BACKGROUND OF THE INVENTION a. Field of the Invention

The present invention relates to a braking device for the ladder lifter of a fire-fighting or high-altitude working extensible ladder truck.

b. Description of the Prior Art

The conventional braking device comprises a hook lever pivotally mounted on a crosspiece of a ladder. Normally said lever is locked in its retracted position on the lifter side, but when the lifting wire rope is broken, the lever is automatically released and swung into engagement with the associated crosspiece, thereby preventing the lowering of the lifter. According to this arrangement, although it is possible to stop the lifter in this manner by making use of the constant spacing between adjacent crosspieces of the ladder when the rope breaks, it sometimes occurs that the lifter falls through a distance up to said crosspiece spacing from the position assumed by the lifter when the rope breaks, giving the rider a great shock or a feeling of uneasiness.

SUMMARY OF THE INVENTION

The present invention provides a braking device for a ladder lifter, characterized in that it comprises a brake cam rotatably mounted on a lifter frame on a ladder rail and opposed to the rail, a spring installed between said lifter frame and said cam and urging the cam to be rotated and pressed against the rail, and a lifter lifting wire rope fastened to a cam lever in such a manner as to cause the cam to be retracted against the force of the spring when said wire rope is tensioned, the arrangement being such that normally the lifter is allowed to be lifted and lowered and stopped as desired, but upon breakage of the wire rope, the brake cam is actuated to brake the lifter so that the latter is securely stopped without falling, at whatever position the lifter assumes on the rail at the time of breakage of the wire rope.

BRIEF DESCRIPTION OF THE DRAWINGS

In the accompanying drawings illustrating a preferred embodiment of the present invention.

DESCRIPTION OF THE PREFERRED EMBODIMENT

Figure 1:
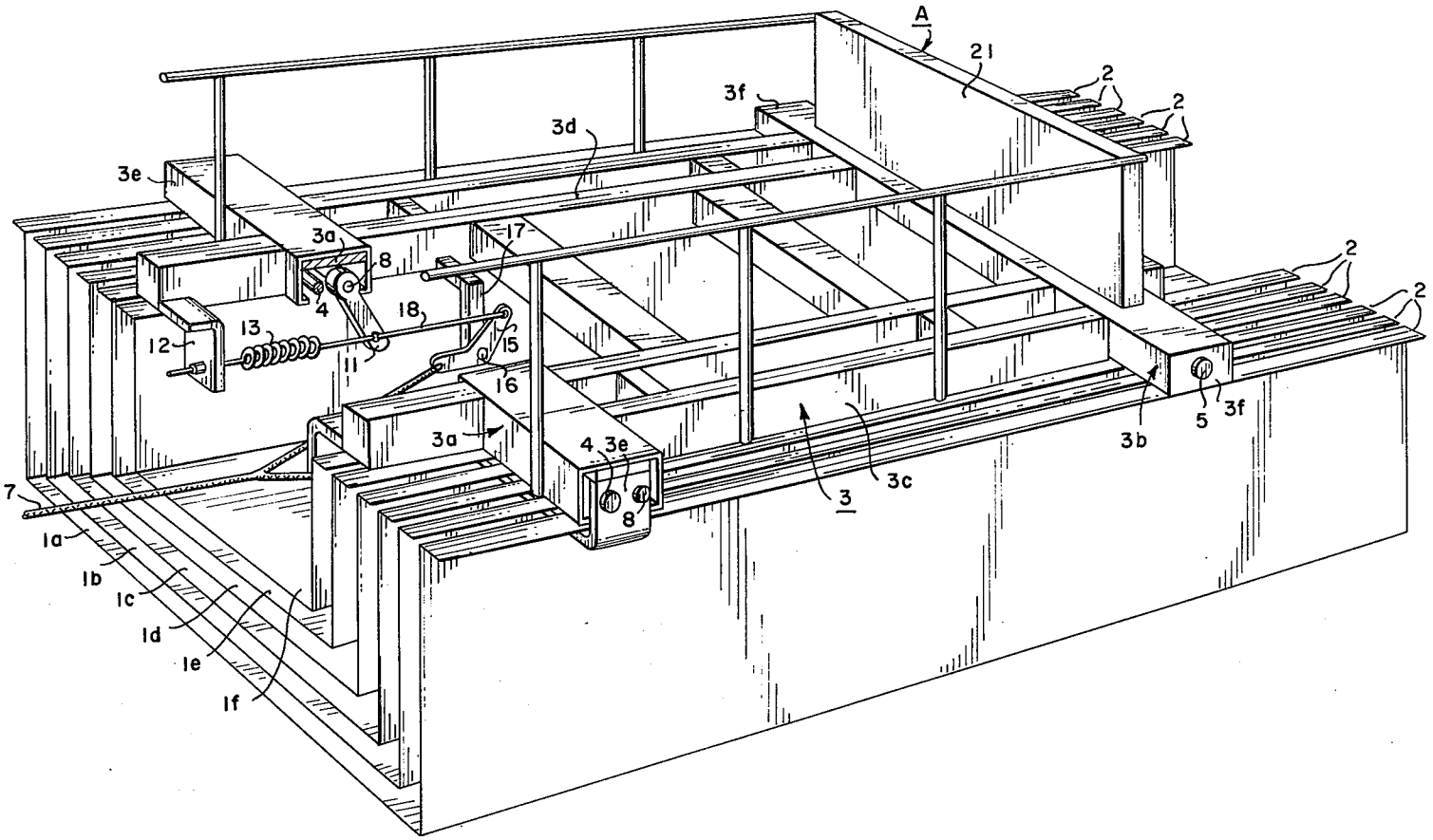
FIG. 1 is a perspective view of a ladder lifter equipped with a braking device according to the invention.
Figure 2:
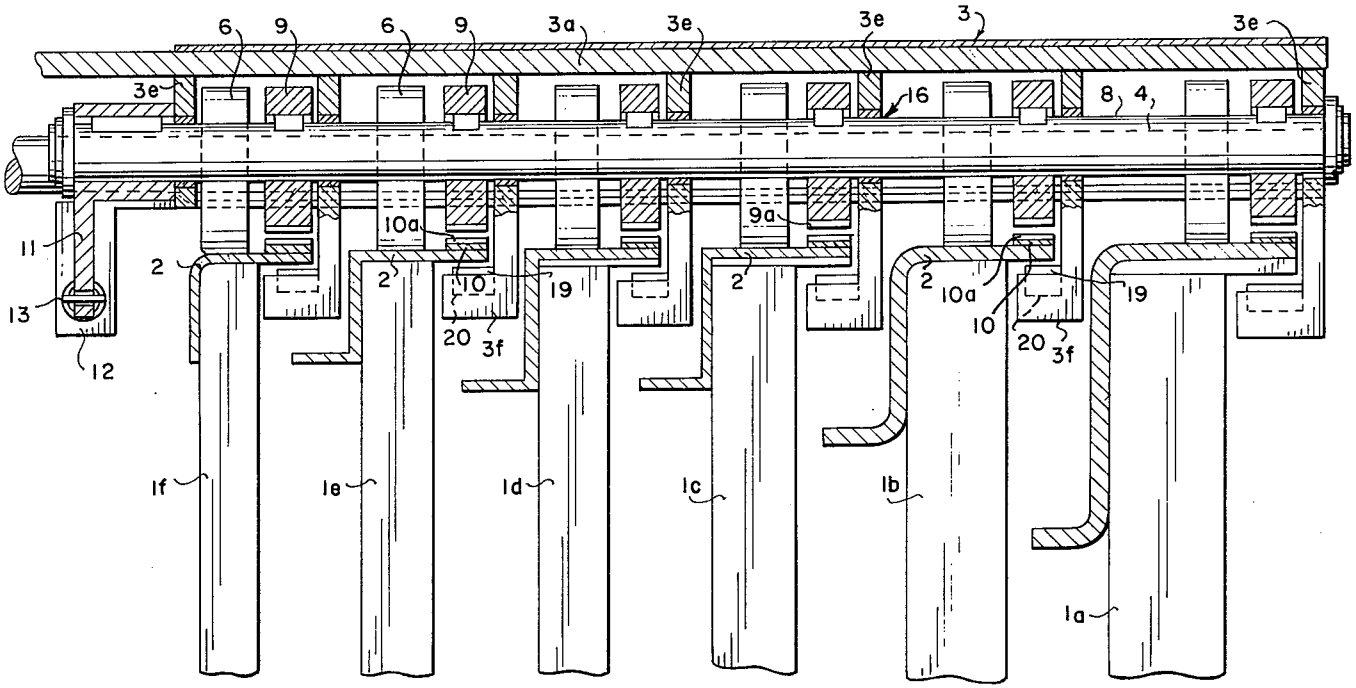
FIG. 2 is a front view, in longitudinal section, of a cam attaching section.
Figure 3:
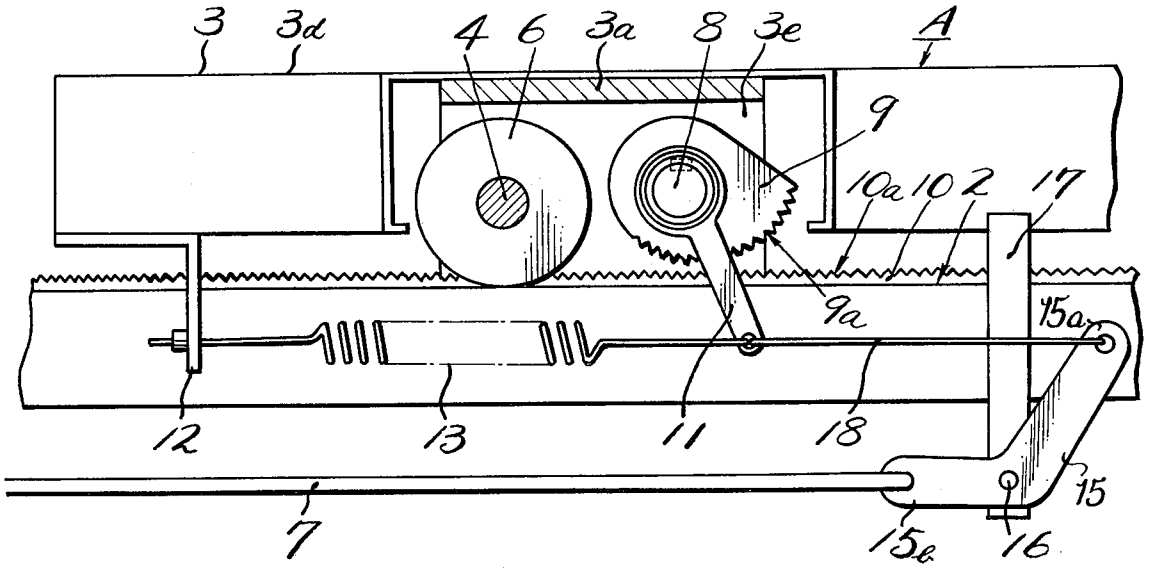
FIG. 3 is a side view of said section.

In FIG. 1, a 6-stage extensible ladder designated at 1 comprises channel-shaped unit ladders 1*a*, 1*b*, 1*c*, 1*d*, 1*e* and 1*f* of the same length but successively reduced in width so that they are extensibly mounted in each other through rollers (not shown). Each unit ladder is formed at its top on both sides with rails 2 outwardly projecting and extending parallel to each other and in the same plane. Designated at A is a lifter adapted to be lifted and lowered along the rails, and 3 designates a frame therefor. The lifter frame consists of cross members 3*a*, 3*b* and side members 3*c*, 3*d*, said cross members being positioned astride the rails 2. Axles 4, 5 are supported between suspension arms 3*e*, 3*f* at opposite ends of the cross members 3*a*, 3*b*. Wheels 6, as shown in FIGS. 2 and 3, are mounted on the axles so that they may roll on the respective rails while carrying the lifter A. It is so arranged that as the lifter A is lifted and lowered with the ladder 1 extended, the lifter is transferred from one unit ladder to another while assuring smooth switching to the rotation of the corresponding wheels associated with said another unit rail. The lifting and lowering of the lifter A is effected by a lifting wire rope 7. The rope extends from a winch drum fixed on a support table for the ladder base, passing in zigzags around pulleys at the bases and front ends of the unit ladders and extending from around the pulley at the front end of the uppermost unit ladder 1*f* to the lifter, to which it is then fastened. During extension and contraction of the ladder, the lifter is maintained stationary on the rear portion of the sixth stage ladder 1*a*. With the ladder 1 held in its erected and extended position, said drum is rotated for winding the rope to lift the lifter. At the time of lowering the lifter, said drum is rotated for unwinding the rope to allow the lifter to descend by its own weight and the weight of the rider. Therefore, if the wire rope 7 breaks when the ladder has been erected, the lifter will slide down the rails. To prevent this, the following braking device is provided. A pair of cam shafts 8 are provided rearwardly of the right and left rows of wheels 6 associated with the cross member 3*a* and extend parallel to the axles 4. Each cam shaft is rotatably supported by arms 3*e* transversely and parallelly spaced on and extending downwardly from the lower surface of the cross mamber 3*a*. Brake cams 9 are fixedly mounted on each cam shaft 8 so as to be opposed to the upper surfaces of the rails 2. As shown in FIG. 3, each cam 9 is formed rearwardly with a raised portion so that when it is rotated in a clockwise direction the raised portion is pressed against the opposed rail 2, thereby preventing the rightward movement as viewed in the Figure, or the lowering, of the lifter A. The cam surface 9*a* has irregularities such as, for example as shown, a serrated surface fit for prevention of slippage between the cam and the rail. A band plate 10 having a irregular surface 10*a* such as, for example as shown, a serrated surface adapted to mesh with said irregularites is fixed to the rail 2 throughout the length thereof to further ensure the brake action. The inner end of each cam shaft 8 has a lever 11 fixed thereto and extending therefrom and a coiled spring 13 is installed under tension between the front end of said lever 11 and a bracket 12 fixed to the frame 3, so that a clockwise torque acts on the cam shaft 8 at all times. Disposed rearwardly of the lever 11 is an L-shaped lever 15 pivotally mounted on a bracket 17 extending from the frame 3 by means of a pivot pin 16. A wire rope or link 18 is connected between the upwardly extending portion 15*a* of the lever 15 and the front end of the lever 11 while the lifter lifting wire rope 7 is tied to the horizontal portion 15*b* of the lever 15. As shown in FIG. 2, the arms 3*e*, except the outermost one, are suspended from the cross member 3*a* outside the respective associated rails by making use of the spacing between adjacent parallel rails. The lower portion 3*f* of each arm 3*e* is bent in an L-shape to extend under the associated rail with a suitable spacing therebetween. To ensure breakage, the surface of the projecting lower portion 3*f* opposed to the rail is provided with a friction plate 19. Designated at 20 is a recess for reception of the same.

FIG. 3 illustrates a condition in which the ladder 1 is erected and the lifting wire rope 7 is under tension. In this condition, the lowering, or rightward movement of the lifter A under loads as viewed in the Figure is restrained by the rope 7 payed out from the ladder front end at the left, through the lever 15, pin 16 and bracket 17. The horizontal arm 15*b* of the lever 15 is shown turned to a position where it is parallel to the ladder rail 2. The erected arm 15*a* is shown turned clockwise to turn the lever 11 to the right against the force of the spring 13 through the rope or link 18. As a result, the cams 9 have been shifted away a suitable distance from the respective associated rails 2. In this condition, if the rope 7 is wound, unwound or stopped by the winch, the lifter A will be lifted, lowered or stopped without hindrance. If the rope 7 should break to lose its tension during such operation, the lever 11 would be instantly swung in a clockwise direction by the tension in the spring 13. Thus, no matter what position on the ladder rails the lifter may assume, the cams on that rail are turned and pressed against the rail. Concurrently therewith, the lifter A is slightly floated up above the upper surface of the rail so that the projecting lower portion 3*f* of the arm below the rail is lifted and pressed against the lower surface of the rail. In other words, the rail 2 is clamped between the cams 9 and the projecting lower portions 3*f* of the arms and the cams 9 are locked against the rail, so that the lifter is braked and stopped. In this case, since the row of brake cams 9 and the row of clamp arms 3*e* forming pairs therewith are installed in the front cross member 3*a*, the lifter is floated up with the rail-engaging wheels in the rear cross member 3*b* serving as a fulcrum. The rear cross member 3*b* is provided with a step 21 as shown in FIG. 1 and since the operator stands on this step, the distribution of the load on the lifter is such that coupled with the ladder inclination, the rear portion of the lifter is more heavily loaded than the front portion thereof, enabling said floating-up to be effected more smoothly. As a result, the clamping of the rails by the cams and arms is ensured.

Further, since the rows of brake cams and arms are disposed on both sides corresponding to the right and left rails, the lifter can be floated up uniformly and symmetrically with respect to the right and left sides, so that the stability is high. Further, since the right and left cam shafts are separate from each other, they can be securely and individually operated without being interfered with by each other. Further, the cams and the upper surface of the rails are prevented from slipping relative to each other by the meshing between their irregularities, and the lower surfaces of the rails and the arms are pressed against each other through the friction plates 19, so that there is no danger of slip occurring when the lifter is braked and stopped.

In addition, thereafter, the broken wire rope 7 will be pieced together or replaced by a new one. When the ladder lies flat on the ladder truck, there is no tension acting on the wire rope 7, so that brakage acts on the lifter during running of the truck.

While the above embodiment refers to an extensible ladder, the invention may also be applied to a single-ladder lifter. Further, the cam shafts may not be separate from each other but they may be combined into a single shaft. Further, the L-shaped lever may be directly fixed to the cam shaft and the lifter lifting wire rope may then be fastened to the horizontal arm with a spring connected to the suspension arm.

What is claimed is:

1. In an aerial ladder assembly having at least one pair of laterally spaced, channel-shaped ladder rails forming a ladder unit, a ladder lifter unit having laterally spaced rotatable wheels mounted thereon for rotational movement along each of said pairs of ladder rails of said ladder unit, rope means associated with said ladder lifter unit to raise or lower said lifter unit along the ladder rails of said ladder unit, the improvement of a braking device for stopping the movement of the ladder lifter unit along the ladder unit upon the breaking of the rope means, said braking device comprising elongated plate element means having a serrated upper surface fixed to the upper surface of each ladder rail of the ladder unit along the longitudinal length of each rail, brake cam element means having a bottom serrated surface pivotally mounted adjacent its upper end to said ladder lifter unit above each of said ladder rails, longitudinally tensionable spring means operatively connected intermediate the respective ends thereof to each brake cam element means, lever means pivotally mounted to said ladder lifter unit and connected at one end to one end of said spring means and at the other end to the rope means, bracket means mounted on said lifter means in longitudinally spaced relationship to said lever means and connected to the other end of said spring means whereby when said rope means are under tension, said spring means will be likewise under tension to maintain the brake cam element means in a raised state away from the serrated plate element means on said ladder rails but upon loss of tension in the rope means, the lever means will be pivoted forwardly causing the spring means to effect the pivoting of the brake cam element means towards the ladder rails to cause a meshing of the serrated surface of the cam element means against the serrated surface of each plate element means of each ladder rail to stop the movement of the ladder lifter unit along the ladder unit.

2. In the aerial ladder assembly in accordance with claim 1, wherein the ladder unit is made up of a plurality of pairs of ladder rails, with each pair being successively reduced in width and extensibly mounted in each other in nesting relationship, said pair of ladder rails each being successively extensible with respect to the other pairs of rails to form an elongated multi-sectioned aerial ladder.

3. In the aerial ladder assembly in accordance with claim 1, wherein said ladder unit includes a plurality of left ladder rails and a plurality of right ladder rails, said ladder lifter unit including a frame member having a left frame portion and a right frame portion corresponding to and movable along the left ladder rails and the right ladder rails respectively, a left cam shaft and a right cam shaft journaled for rotation in the left frame portion and the right frame portion respectively, each of said brake cam element means being journaled for rotation on either a left cam shaft or a right cam shaft respectively, left lever means and right lever means pivotally connected respectively to the left and right frame portions of the frame member, left bracket means and right bracket means fixedly connected to the left and right frame portions respectively of the ladder unit and in longitudinal spaced relationship with respect to said lever means, left spring means and right spring means connected at one end to said left lever means and to right lever means respectively and at its opposite ends to sid left and right bracket means respectively, said left spring means and right spring means being connected intermediate the respective ends of each of the left brake cam element means and the right brake cam element means respectively, and single rope means connected to the left lever means and the right lever means respectively.

* * * * *